US006164487A

United States Patent [19]

Hicks

[11] Patent Number: 6,164,487

[45] Date of Patent: Dec. 26, 2000

[54] INSULATED JACKET FOR A BEVERAGE CONTAINER AND BLANK AND METHOD FOR FABRICATING SAME

[75] Inventor: Michael E. Hicks, Mesquite, Tex.

[73] Assignee: Numo Manufacturing Company, Inc., Mesquite, Tex.

[21] Appl. No.: 09/484,325

[22] Filed: Jan. 18, 2000

Related U.S. Application Data

[62] Division of application No. 09/263,127, Mar. 5, 1999, Pat. No. 6,059,140.

[60] Provisional application No. 60/077,846, Mar. 31, 1998.

[51] Int. Cl.[7] ..... B65D 25/20

[52] U.S. Cl. ..... 220/739; 220/62; 220/6; 220/903; 220/677; 112/475.08

[58] Field of Search ..... 112/475.08; 220/6, 220/62, 903, 739, 737, 592.24, 592.17, 592.16, 610, 606, 604, 677, 678, 679, 915.2, 915.1

[56] References Cited

U.S. PATENT DOCUMENTS

| | | | |
|---|---|---|---|
| 2,103,092 | 12/1937 | Robinson | 112/475.08 |
| 4,194,652 | 3/1980 | Williamson et al. | 222/181.3 |
| 4,540,611 | 9/1985 | Henderson | 428/12 |
| 4,628,007 | 12/1986 | Ledsham | 428/542.8 |
| 5,169,025 | 12/1992 | Guo | 220/739 |
| 5,445,315 | 8/1995 | Shelby | 229/117.06 |
| 5,845,806 | 12/1998 | Parchman | 220/739 |
| 6,026,983 | 2/2000 | Graham | 220/738 |

*Primary Examiner*—Stephen Castellano

*Attorney, Agent, or Firm*—Kennedy Covington Lobdell & Hickman, LLP

[57] ABSTRACT

An insulative jacket for a beverage container is fabricating from a unitary blank of flexible insulative material into a main body forming an annulus with continuous upper and lower edges openable into an annular form for receiving the beverage container and collapsible along diametrically opposed fold lines into a flattened rectangular form when not in use, and a circular end wall connected to the lower edge of the annulus at diametrically opposed locations with a sewn fold line bisecting the wall to urge it to fold inwardly within the annulus when collapsed into the flattened rectangular form.

6 Claims, 2 Drawing Sheets

INSULATED JACKET FOR A BEVERAGE CONTAINER AND BLANK AND METHOD FOR FABRICATING SAME

CROSS-REFERENCE TO RELATED APPLICATION

This disclosure incorporates and has the priority of U.S. Provisional Patent Application Ser. No. 60/077,846, filed Mar. 13, 1998, entitled INSULATED JACKET FOR A BEVERAGE CONTAINER, and is a division of U.S. application Ser. No. 09/263,127, filed Mar. 5, 1999, also entitled INSULATED JACKET FOR A BEVERAGE CONTAINER, now U.S. Pat. No. 6,059,140.

BACKGROUND OF THE INVENTION

The present invention relates generally to insulated devices for slowing temperature loss in heated or cooled beverages and, more particularly, to insulated jackets of the type which fit about a beverage container, especially a single-serving container such as a convention aluminum beverage can.

Conventionally, beverages of all types, ranging from soft drinks to fruit juices to beer, are packaged for consumption in single-serving containers of various sorts. Because of ease of manufacture and the ability to recycle and reuse the constituent materials, aluminum and various moldable thermoplastic materials are most commonly used for such beverage containers, with aluminum cans of a twelve-ounce size being the most common form and size of such beverage containers.

While such beverage containers offer many advantages, including recyclability as already mentioned, non-breakability, and low relative weight, one of the disadvantages is that the relative low weight and thin-wall construction of such containers provides little resistance against heat transfer to or from the beverage within the container. Hence, chilled beverages, in particular, tend to rapidly gain temperature once the beverage container is taken from a chilled environment, e.g., a refrigerator, and opened for consumption.

To address this problem, a considerable number and variety of different forms of insulated devices for jacketing beveraged cans have been developed over recent years to act as holders for beverage cans while being consumed, the insulative character of such devices acting to minimize heat transfer from the warmer ambient atmosphere to the chilled beverage within the container. One popular form of such devices is made of foamed synthetic thermoplastic material commonly called foam rubber, formed as a cylindrical jacket dimensioned to closely encircle a standard twelve-ounce beverage can. Such devices typically also include a circular foam rubber bottom wall to provide additional insulative properties. Other similar cylindrical jacket devices are made in substantially the same configuration of relatively hard inflexible dual-walled plastic material within which is contained an insulating material.

While these devices function well for their intended purpose, they suffer the disadvantage of being relatively bulky and inconvenient to carry when not in use, since such devices cannot be folded, collapsed or otherwise placed within normal-sized pockets in typical clothing articles. A more recent form of insulated beverage container jacket is made of a relatively thin-walled synthetic foam rubber material (typically of a thickness of about one-eighth inch) covered on each face by a textile fabric laminated or otherwise bonded to the synthetic foam rubber. Such jackets are made from a single piece of flat fabric-surfaced foam rubber material cut as a blank in the shape of two rectangles spaced endwise from one another by an intervening circular web of the same material, the blank being fabricated into the jacketing device by sewing or otherwise affixing together the respective side margins of the two rectangular portions whereby the sewn rectangular portions form an annulus of the material formable into a cylindrical shape to fit about a beverage can with the connecting circular web in turn forming an insulative bottom wall to the jacket.

One of the advantages of this form of insulating beverage jacket is that, when not in use, the opposite rectangular wall portions tend to reassume their original flattened configuration, whereby the device can be more readily carried in the pocket of an article of clothing. However, due to the manner of construction described above, the circular connecting web of the device naturally tends to project away from the rectangular sidewalls when the device is not in use, thereby increasing the overall outer dimensions of the device which detracts from the ease of placing the device into a pocket.

SUMMARY OF THE INVENTION

It is accordingly an object of the present invention to provide an improved form of insulating beverage container jacket which can be more compactly collapsed for carrying in a pocket of clothing. A more particular object of the present invention is to provide an insulating beverage container jacket made of thin-walled fabric-backed synthetic foam rubber generally like that of the known form of jacketing device described above but wherein the bottom insulating wall is adapted to naturally collapse into the annulus of the device, whereby the device naturally assumes a more compact, generally rectangular configuration when not in use and is thereby more conveniently stowed in a pocket of clothing. A further and more particular object of the present invention is to provide a unique configuration of a blank of the fabric-backed foamed rubber insulating material from which the jacketing device of the present invention may be fabricated to achieve the foregoing properties.

Briefly summarized, these objects of the present invention are achieved in an insulative beverage container jacketing device fabricated of a relatively thin-walled synthetic foam rubber (or other synthetic foamed thermoplastic material) covered on both opposite surfaces with outer layers of textile fabric. The device basically comprises a main annular body configured and dimensioned to be compatible with a standard-sized conventional beverage container, e.g., a conventional twelve-ounce aluminum beverage can (although it will be understood that the dimensions of the device can be readily modified to be compatibly sized for receiving substantially any shape and size of beverage container). The device additionally includes a generally circular bottom wall connected at diametrically opposite locations to the annular body at a lower edge thereof, but otherwise unconnected to the annular body, thereby permitting the annular body and the bottom wall to assume a flattened condition when not in use. In accordance with the present invention, the bottom wall is formed with an inwardly-facing seam or fold substantially bisecting the bottom wall between the opposed locations of attachment to the annular body, the seam biasing or otherwise urging the bisected halves of the bottom wall to fold relative to one another into the interior of the annular body when not in use, and to resist any tendency to project outwardly away from the annular body.

In a preferred embodiment, the insulative beverage container jacket of the present invention is fabricated from a flat blank of the preferred synthetic fabric-backed foamed insulating material cut in the shape of an elongated rectangle with semi-circular portions extending outwardly from one longitudinal side of the rectangle at spacings therealong. The jacketing device is formed by sewing or otherwise joining the opposite ends of the rectangle, thereby forming the main annular body of the device, and by sewing together or otherwise joining the respective outward edges of the two semi-circular portions, which thereby together form the bottom wall of the device. The seam between the two semi-circular portions is preferably formed as a lap-type seam facing inwardly of the annular body, whereby the seam acts to bias or urge the two semi-circular portions to fold inwardly within the annular body.

DESCRIPTION OF THE PREFERRED EMBODIMENT

Figure 1:
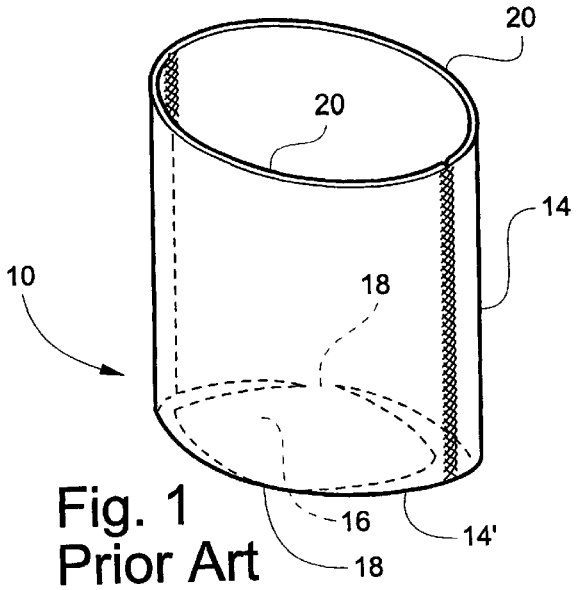
Fig. 1 Prior Art
FIG. 1 is a perspective view of a prior art insulated beverage container jacket of the type described above, shown in a partially opened condition ready for insertion of a beverage container.
Figure 2:
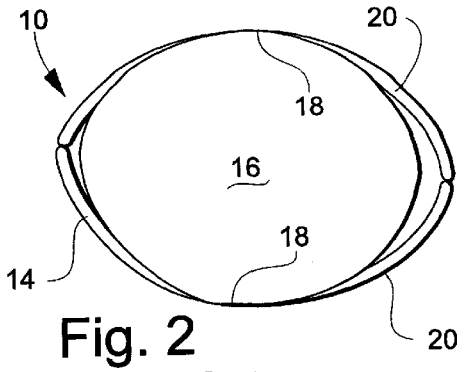
Fig. 2 Prior Art
FIG. 2 is a bottom plan view of the prior art insulated beverage container jacket of FIG. 1, also shown in the same partially opened use condition.
Figure 3:
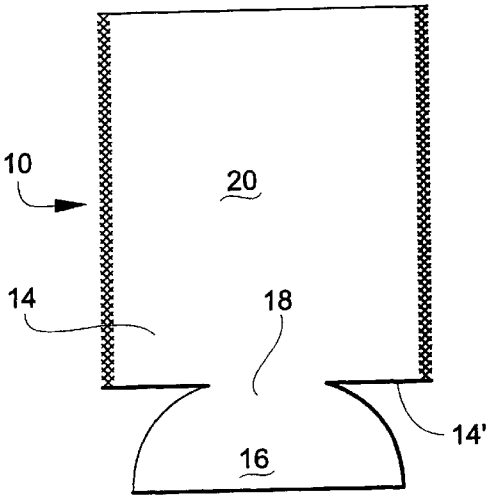
Fig. 3 Prior Art
FIG. 3 is a side elevational view of the prior art insulated beverage container jacket of FIGS. 1 and 2, shown in its flattened storage condition.
Figure 4:
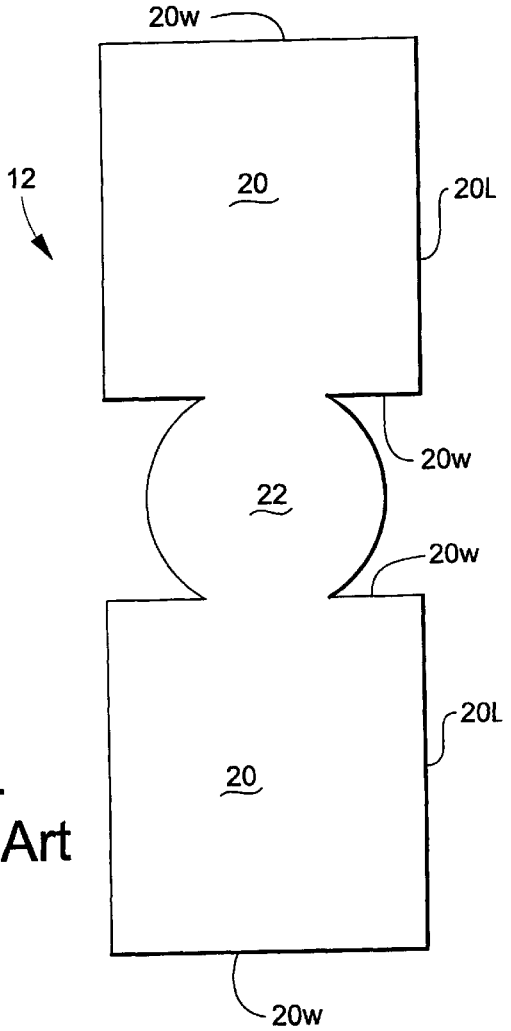
Fig. 4 Prior Art
FIG. 4 is a plan view of a prior art blank of insulating material from which the beverage container jacket of FIGS. 1–3 is fabricated.

Referring now to the accompanying drawings and initially to FIGS. 1–4, a known prior art insulated beverage container jacket of the type briefly described above is indicated generally at 10 in finished form in FIGS. 1–3 and at 12 in FIG. 4 in blank form from which the jacket 10 is fabricated. The jacket 10 basically comprises a main annular body 14 which can be opened into an essentially cylindrical shape as shown in FIGS. 1 and 2 but can also be flattened into a generally planar form as shown in FIG. 3, with an essentially circular bottom wall 16 connected to the lower edge 14' at diametrically opposite locations 18 but otherwise unconnected to the lower edge 14' of the annular body 14 whereby the bottom wall 16 substantially spans transversely the area within the lower edge 14' in the opened condition of the jacket 10, as shown in FIGS. 1 and 2, and is foldable into two face-butting semi-circular portions projecting downwardly from the edge 14' outwardly away from the annular body 14 when in the flattened condition of FIG. 3.

The jacket 10 of the known device is fabricated from a conventional thin-walled polymeric foam material commonly referred to as synthetic foam rubber, having a textile fabric bonded to the opposite outward faces of the foam. As shown in FIG. 4, the jacket 10 is fashioned from a blank 12 cut from a flat web of such material into the indicated shape having two rectangular portions 20, each of a lengthwise dimension **20*l* corresponding to the height, i.e., axial length, of the annular body 14 and each of a width 20*w* corresponding to one-half of the circumference of the annular body 14, the two rectangular portions 20 being connected at an endwise (lengthwise) spacing by a circular portion 22 extending between adjacent widthwise ends 20*w* of the two rectangular portions 20 and being of a diameter substantially corresponding to the annular body 14**.

The jacket 10 is thus fabricated from the blank 12 by folding the blank 12 lengthwise to place the two rectangular portions 20 in face-butting coextensive relationship and then sewing together the juxtaposed lengthwise edges **20*l* of the two rectangular portions 20, thereby producing the flattened jacket 10 of FIG. 3. As thusly sewn together, the two rectangular portions 20 collectively form the annular body 14 while the circular portion 22 forms the circular bottom wall 16**.

As already indicated above, the jacket 10 of this prior art construction functions satisfactorily for its intended purpose to receive a conventional beverage container, e.g., a conventional 12-ounce size aluminum can, within the interior of the annular body 14, but the jacket 10 is less than optimally convenient to carry when not in use because the circular portion 22 forming the circular bottom wall 16 projects outwardly from the annular body 14 as shown in FIG. 3, thereby increasing the overall dimension of the jacket 10 in its folded storage condition.

Figure 5:
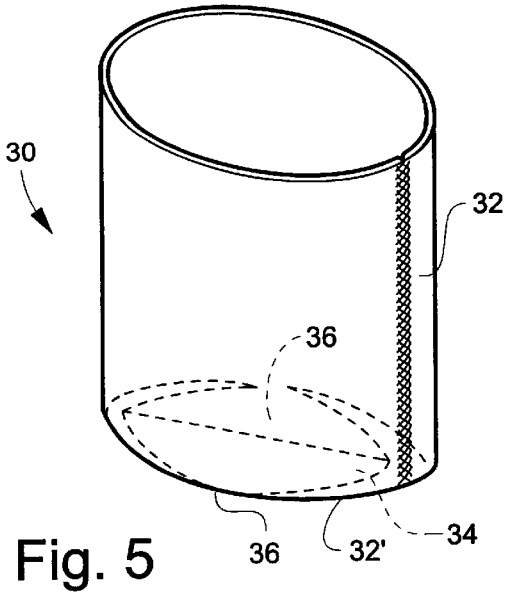
FIG. 5 is a perspective view of an insulated beverage container jacket in accordance with a preferred embodiment of the present invention, shown in a partially opened condition ready for insertion of a beverage container.
Figure 6:
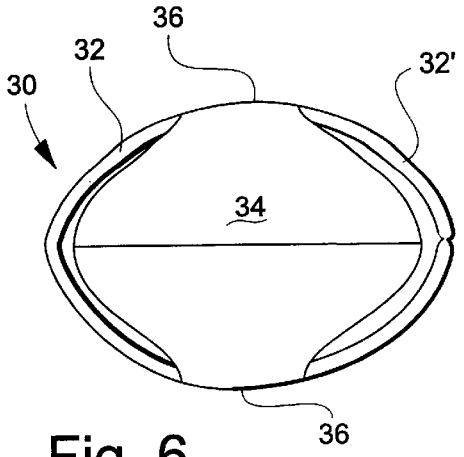
FIG. 6 is a bottom plan view of the insulated beverage container jacket of the present invention shown in FIG. 5, also depicted in the same partially opened condition thereof.
Figure 7:
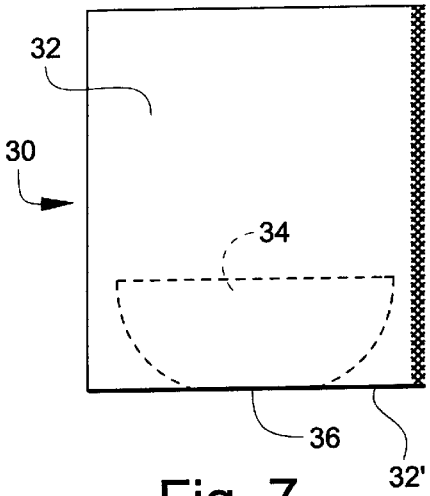
FIG. 7 is a side elevational view of the insulated beverage container jacket of FIGS. 5 and 6 of the present invention, shown in its flattened storage condition.

Referring now to FIGS. 5–8, the improved insulated beverage jacket container of the present invention is indicated generally at 30, shown in opened condition ready for use in FIGS. 5 and 6 and in flattened storage condition in FIG. 7. The jacket 30 basically comprises an annular body 32 with an essentially circular bottom wall 34 connected to the lower edge 32' of the annular body 32 at diametrically opposite locations 36 but otherwise unconnected to the annular body 32. In this manner, in the opened condition of the jacket 30 shown in FIGS. 5 and 6, the annular body 32 assumes an essentially cylindrical shape to receive a beverage container within the interior of the annular body 32, with the bottom wall 34 substantially spanning the circular area within the opened lower edge 32' of the body 32 in such condition. When not in use, the jacket 30 may be folded into an essentially flattened condition shown in FIG. 7, wherein the annular body 32 assumes an essentially flattened rectangular configuration, with the circular bottom wall 34 folded upon itself into two face-butting semi-circular portions nested inwardly within the folded annular body 32, such that the overall folded configuration of the jacket 30 is rectangular without any portion of the jacket 30 projecting outwardly of the annular body 32.

Figure 8:
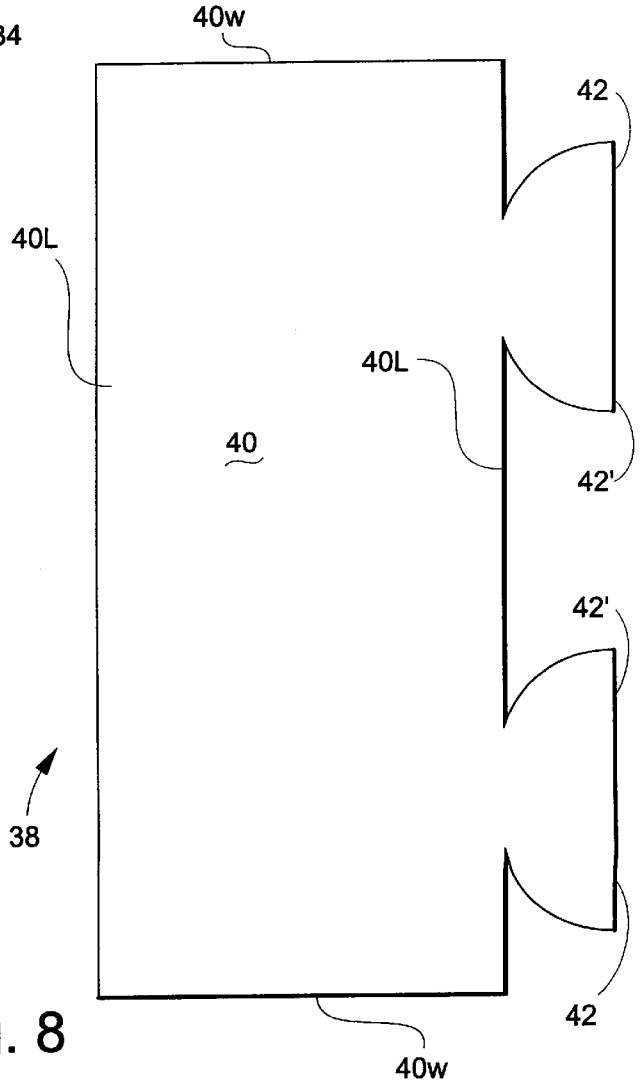
FIG. 8 is a plan view of a blank of insulating material in accordance with the present invention, from which the insulated beverage container jacket of FIGS. 5–7 is fabricated.

This configuration of the jacket 30 is created by fabricating the jacket 30 from the blank 38 shown in FIG. 8. Like the known jacket 10 of the prior art, the jacket 30 is fabricated from a relatively thin-walled thermoplastic polymeric foam material, such as conventional synthetic foam rubber, having a textile fabric covering laminated or otherwise bonded to the two outward surfaces of the foam material, thereby to provide the desired insulating properties. The blank 38 of FIG. 8 is cut from a flattened web of such material into the depicted shape providing a single continuous elongated rectangular portion 40, the length **40*l* of which corresponds to the circumference of the annular body 32 and the width 40***w* of which corresponds to the height, i.e., axial length, of the annular body 32. Two semi-circular portions 42 extend outwardly from spaced locations along one lengthwise side 40*l* of the rectangular portion 40.

Thus, the jacket 30 is fabricated from the blank 38 by folding the rectangular portion 40 lengthwise to bring its opposite widthwise edges 40*w* into co-extensive juxtaposition, while simultaneously bringing the two semi-circular portions 42 into face abutment. The juxtaposed widthwise edges 40*w* and the juxtaposed outward linear edges 42' of the two semi-circular portions 42 are then secured to one another. Essentially any conventional means of securement may be utilized, e.g., welding, gluing, sewing or the like, but it is preferred that each seam thusly created be an overlapping type of seam. As thusly created, the jacket 30 is then everted to orient the overlapping seams to face inwardly of the jacket interior. As a result, a more pleasing outward appearance of the seams is created, but more importantly the inwardly facing orientation of the overlapping seam between the edges 42' of the two semi-circular portions 42 causes the bottom wall 34 to be biased or urged to fold inwardly within the annular body 32 when not in use and resists any tendency of the two semi-circular portions 42 to project axially outwardly from the annular body 32.

Advantageously, therefore, the jacket 30 of the present invention provides all of the same advantages as the known jacket 10 in respect to compactness, lightweight and foldability. However, the jacket 30 at the same time overcomes the disadvantage of the known jacket 10 in avoiding any tendency of the circular bottom wall 34 to project outwardly from the annular body 32 when the jacket 30 is not in use. The jacket 30 may thus be conveniently folded into a more compact rectangular shape when not in use and can easily be carried in most pockets of most garments. Further, the jacket 30 when unfolded will tend to assume an opened cylindrical shape so as to be self-standing which simplifies convenient insertion of a beverage can and also better enables retail display and use of the jacket.

An additional important advantage of the present invention is that because of the unique construction of the jacket 30, only a single side seam is created in the annular body 32, thereby enabling graphics to be printed on the exterior surface of the annular body 32 substantially uninterrupted about essentially its entire annular extent. In contrast, as will be seen from FIGS. 1–4, prior art jackets such as the jacket 10 have two diametrically opposed side seams in its annular body 14, which thereby restrict the placement and size of graphics on the exterior surface of the jacket. As will be understood, insulated beverage jackets of this type characteristically carry distinctive promotional graphics on the exterior surface and, hence, this feature of the present jacket 30 provides substantially greater flexibility and variety in the size, type and arrangement of graphics which can be placed on the jacket 30.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A method of fabricating an insulative jacket for a beverage container, comprising the steps of:

(a) providing a blank formed as a generally planar web of flexible insulative material including a main elongated rectangular body portion defined by opposed end edges and opposed lengthwise edges of a length sufficient to encircle the beverage container when the end edges are abutted with one another and two semicircular wall portions extending from one lengthwise edge at a spacing therealong selected to be abutted with one another when the end edges of the main body are abutted, (b) joining the end edges of the main body in abutment with one another to form an annulus with one lengthwise edge forming a continuous upper edge and the other lengthwise edge forming a continuous lower edge openable into a generally annular form defining an interior area of a shape and dimension for receiving the beverage container through the upper edge and collapsible along diametrically opposed fold lines into a flattened rectangular form when not in use, and (c) joining the two semicircular wall portions to form a generally circular end wall connected to the lower edge of the annulus at diametrically opposed locations with the joining forming a fold line bisecting the wall between the opposed locations and biased inwardly of the annulus to urge the wall to fold within the annulus when collapsed into the flattened rectangular form.

2. A method of fabricating an insulative jacket for a beverage container according to claim 1, wherein the joining of the end edges of the main body comprises sewing the end edges of the main body together.

3. A method of fabricating an insulative jacket for a beverage container according to claim 2, wherein the sewing of the end edges of the main body comprises forming a scam facing inwardly of the annulus of the main body to urge the main body to collapse into the flattened rectangular form.

4. A method of fabricating an insulative jacket for a beverage container according to claim 1, wherein the joining of the two semicircular wall portions comprises sewing the two wall portions together.

5. A method of fabricating an insulative jacket for a beverage container according to claim 4, wherein the sewing of the two semicircular wall portions comprises forming a seam facing inwardly of the annulus of the main body to urge the circular end wall to fold within the annulus when collapsed into the flattened rectangular form.

6. An insulative jacket for a beverage container made according to the method of claim 1.

* * * * *

UNITED STATES PATENT AND TRADEMARK OFFICE

CERTIFICATE OF CORRECTION

PATENT NO. : 6,164,487 
APPLICATION NO. : 09/484325
DATED : December 26, 2000
INVENTOR(S) : Michael E. Hicks It is certified that error appears in the above-identified patent and that said Letters Patent is hereby corrected as shown below:

On the title page, item [75], delete the name and address "Michael E. Hicks, Mesquite, Texas" and insert therefor the name and address --Thomas L. Vorderkunz, Waco, Texas--.

Signed and Sealed this

Twenty-eighth Day of November, 2006

JON W. DUDAS
*Director of the United States Patent and Trademark Office*